US009839943B2

(12) United States Patent
Barney et al.

(10) Patent No.: US 9,839,943 B2
(45) Date of Patent: Dec. 12, 2017

(54) ADHESIVE SCOOP HAVING A RIGID UNITARY FORM WITH PLURALITY OF FILLETS

(71) Applicant: The Boeing Company, Chicago, IL (US)

(72) Inventors: Christopher Blaine Barney, Everett, WA (US); Lyle J. True, Stanwood, WA (US); Jerome Jacques Maurice Demoulin, Everett, WA (US)

(73) Assignee: THE BOEING COMPANY, Chicago, IL (US)

( * ) Notice: Subject to any disclaimer, the term of this patent is extended or adjusted under 35 U.S.C. 154(b) by 476 days.

(21) Appl. No.: 14/183,781

(22) Filed: Feb. 19, 2014

(65) Prior Publication Data

US 2015/0231775 A1 Aug. 20, 2015

(51) Int. Cl.

| | |
|---|---|
| ***B08B 1/00*** | (2006.01) |
| ***B25B 33/00*** | (2006.01) |
| *B44D 3/16* | (2006.01) |
| *A47L 17/06* | (2006.01) |

(52) U.S. Cl.

CPC ..... *B08B 1/005* (2013.01); *B08B 1/008* (2013.01); *A47L 17/06* (2013.01); *B08B 2220/01* (2013.01); *B44D 3/162* (2013.01)

(58) Field of Classification Search

CPC ..... A47L 13/02; A47L 13/08; B08B 1/001; B08B 1/005; B08B 1/008; B08B 2220/01

USPC ..... 15/263.07, 263.01

See application file for complete search history.

(56) References Cited

U.S. PATENT DOCUMENTS

| | | | | | |
|---|---|---|---|---|---|
| 1,211,062 | A * | 1/1917 | Bowman | A47G 21/04 | 15/236.01 |
| 1,306,931 | A * | 6/1919 | Thomas | F24B 15/08 | 209/342 |
| 1,354,709 | A * | 10/1920 | Williams | A47L 13/08 | 30/169 |
| 1,367,032 | A * | 2/1921 | Ferdon | A47J 43/288 | 15/236.01 |
| 2,008,952 | A * | 7/1935 | Gach | E04D 15/04 | 15/245.1 |
| 2,114,703 | A * | 4/1938 | Conner | H05B 3/00 | 219/227 |
| 2,212,197 | A * | 8/1940 | Rudolph | B44D 3/162 | 15/236.07 |
| 2,399,800 | A * | 5/1946 | Harte | B21D 53/66 | 294/49 |
| 2,634,497 | A * | 4/1953 | Waldesbuehl | A47G 21/04 | 15/236.08 |

(Continued)

FOREIGN PATENT DOCUMENTS

| | | | | |
|---|---|---|---|---|
| DE | 102005006948 | A1 * | 8/2006 | A47L 1/16 |
| GB | WO 8910850 | A1 * | 11/1989 | B44D 3/164 |

(Continued)

*Primary Examiner* — Joseph J Hail
*Assistant Examiner* — Arman Milanian
(74) *Attorney, Agent, or Firm* — Yee & Associates, P.C.

(57) ABSTRACT

A method and apparatus for removing a viscous material from a structure. The apparatus may comprise a base section. The base section may be configured to move along a surface of a first part and a second part of the structure. The base section may have sides that form a pocket. The sides may have a shape that substantially conforms to the surface of the first part and the second part of the structure.

31 Claims, 11 Drawing Sheets

(56) References Cited

U.S. PATENT DOCUMENTS 2,807,168 A * 9/1957 Wipf ..... G01F 19/00 15/236.06
D184,317 S * 1/1959 McArthhur ..... 30/147
2,981,964 A * 5/1961 Downing ..... A63B 57/60 15/105
3,079,622 A * 3/1963 Smyers ..... E04F 21/1655 15/235.7
3,672,002 A * 6/1972 Penman ..... A22C 25/006 30/149
3,804,450 A * 4/1974 Guenzel ..... A01B 1/20 294/180
4,248,660 A * 2/1981 Johnson ..... A47L 13/08 15/236.01
D269,060 S * 5/1983 Creamer ..... D7/644
4,508,588 A * 4/1985 Parrish ..... B65C 11/00 15/236.01
4,549,350 A * 10/1985 Patillo ..... A47G 27/0487 15/236.05
4,627,128 A * 12/1986 Shea ..... B08B 1/00 15/104.001
4,779,301 A * 10/1988 Millette ..... E04G 23/006 15/105
4,881,291 A * 11/1989 Ellis ..... A63F 3/068 15/104.8
5,075,916 A * 12/1991 Englehart ..... E04F 21/165 15/105
5,282,711 A * 2/1994 Frische ..... A47G 19/02 414/744.4
5,345,642 A * 9/1994 Faldetta ..... A47L 17/06 15/105
5,477,583 A * 12/1995 Deloe ..... A47L 13/26 15/236.01
5,533,768 A * 7/1996 Mitchell ..... B25G 1/01 294/54.5
5,547,240 A * 8/1996 Hartshorn ..... A01B 1/02 294/49
D389,964 S * 1/1998 Lewandowski ..... 401/139
5,706,546 A * 1/1998 Utley ..... A47J 43/281 15/143.1
5,765,648 A * 6/1998 Sheehan ..... A01B 1/00 172/381
5,875,515 A * 3/1999 Dallas ..... A47J 43/288 15/236.01
6,145,204 A * 11/2000 Cash ..... A47G 21/02 30/322
6,575,511 B2 * 6/2003 Hultstrand ..... B60S 3/045 15/105
6,886,229 B1 * 5/2005 Wilson ..... B25B 27/04 29/267
6,935,941 B1 * 8/2005 Muehlenbeck ..... A22C 25/006 452/103
7,127,769 B2 * 10/2006 Chang ..... E04F 21/165 15/105
8,066,080 B1 * 11/2011 Hanson ..... A01B 1/02 172/13
D659,558 S * 5/2012 Johnson ..... D10/46.2
D696,325 S * 12/2013 Dekar ..... D15/199
8,714,607 B1 * 5/2014 Suber ..... A01B 1/065 294/50
D750,837 S * 3/2016 Gast ..... D28/57
2006/0021175 A1 * 2/2006 Peroni ..... A47L 13/022 15/236.02
2007/0256260 A1 * 11/2007 Bretzke ..... A01M 31/00 15/105
2011/0203064 A1 * 8/2011 Gringer ..... E04F 21/165 15/105.5
2013/0233345 A1 * 9/2013 Baarsch ..... A47L 13/03 134/6
2016/0021810 A1 * 1/2016 Cooke ..... A01B 1/20 294/51

FOREIGN PATENT DOCUMENTS

GB WO 2007039247 A1 * 4/2007 ..... E04F 21/1652
WO 0112450 A1 2/2001
WO 2008076603 A1 6/2008

* cited by examiner

ADHESIVE SCOOP HAVING A RIGID UNITARY FORM WITH PLURALITY OF FILLETS

BACKGROUND INFORMATION

1. Field

The present disclosure relates generally to manufacturing and, in particular, to manufacturing using adhesives. Still more particularly, the present disclosure relates to a method and apparatus for removing excess adhesive.

2. Background

Manufacturing an aircraft may be a complex and time consuming process. Manufacturing an aircraft may include, for example, without limitation, fabricating parts, assembling parts, installing systems, inspections, and other suitable operation for manufacturing the aircraft.

One operation performed in assembling parts may include connecting parts to each other to form structures for the aircraft. The connecting may be one or more of fastening, bonding, or other suitable operations. The bonding of parts to each other may be performed using an adhesive.

For example, without limitation, brackets may be bonded to various parts of an aircraft using an adhesive (or sealant). The bonding process for bonding a bracket to a panel may require the entire surface area of the bracket to be covered with the adhesive prior to installation. After the bracket is installed, some of the adhesive may squeeze out of the edges of the bracket onto the surface of the panel. This visual cue of the adhesive may indicate that a sufficient amount of adhesive was used to bond the bracket to the panel. This visual cue may be referred to as a "squeeze out."

Leaving the squeeze out on the panel, bracket or both may be undesirable. Removing the squeeze out may be more time consuming to clean and messier than desired. Currently, a tool, such as a wood tongue depressor, may be used to remove some of the adhesive in the squeeze out. Thereafter, a towel with alcohol or some other solvent may be used to remove the remaining portions of the squeeze out from the surface of the panel. This current process may take more time and effort than desired.

Therefore, it would be desirable to have a method and apparatus that take into account at least some of the issues discussed above, as well as other possible issues.

SUMMARY

In one illustrative embodiment, an apparatus may comprise a base section. The base section may be configured to move along a surface of a first part and a second part of a structure. The base section may have sides that form a pocket. The sides may have a shape that substantially conforms to the surface of the first part and the second part of the structure.

In another illustrative embodiment, a method for removing a viscous material from a structure may be provided. A scoop may be moved along a surface of a first part and a second part in the structure. The scoop may have a base section with sides having a shape that substantially conforms to the surface of the first part and the second part of the structure. A portion of the viscous material may be guided on the surface of the structure into a pocket formed by the sides of the base section of the scoop as the scoop moves along the surface of the structure.

In yet another illustrative embodiment, an adhesive scoop may comprise an elongate member and a base section associated with an end of the elongate member. The base section may have an angle relative to the elongate member and sides that form a pocket. The sides may have a shape that substantially conforms to a surface of a first part and a second part of a structure. The sides may be configured to move along the surface of the first part and the second part of the structure. The sides may be configured to move along the structure and guide a viscous material on the surface of the structure into the pocket when the sides move along the first part and the second part of the structure. The sides may have an outer surface with a first contour configured to correspond to a shape of the surface of the portion of the structure. The sides may have an inner surface with a second contour configured to guide the viscous material into the pocket. The second contour may include a number of fillets configured to move the viscous material into the pocket. The sides may comprise a bottom side and a number of walls that extend from the bottom side to form the pocket. The number of walls may extend at an angle relative to the bottom side. The base section may have a leading edge located on the bottom side. The leading edge may be configured to contact the surface of the structure and the viscous material on the surface of the structure. A guide structure may be physically associated with a bottom side of the base section such that the leading edge maintains a desired angle when the guide structure and the leading edge contact the surface of the structure. The structure may be comprised of parts selected from at least one of a panel, a bracket, a stringer, a fuselage, a fuel tank, an airframe, a composite structure, or a skin panel.

In still another illustrative embodiment, a method may set an angle of a scoop. A guide structure physically associated with a bottom side of the scoop may be placed such that the angle for a leading edge is set to a desired angle when the guide structure and the leading edge contact the surface of the first part of the structure.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account one or more considerations. For example, the illustrative embodiments recognize and take into account that removing adhesive from a structure may take more time and effort than desired. The illustrative examples recognize and take into account that currently used methods for removing adhesive from a structure may not be as efficient as desired.

Thus, the illustrative embodiments provide a method and apparatus for removing a viscous material from a structure. In one illustrative example, viscous material may be removed using an apparatus. The apparatus may comprise an elongate member and a base section. The base section may be physically associated with an end of the elongate member in which the base section is configured to move along a surface of the structure and guide a viscous material on the surface of the structure into a pocket in the base section.

Figure 1:
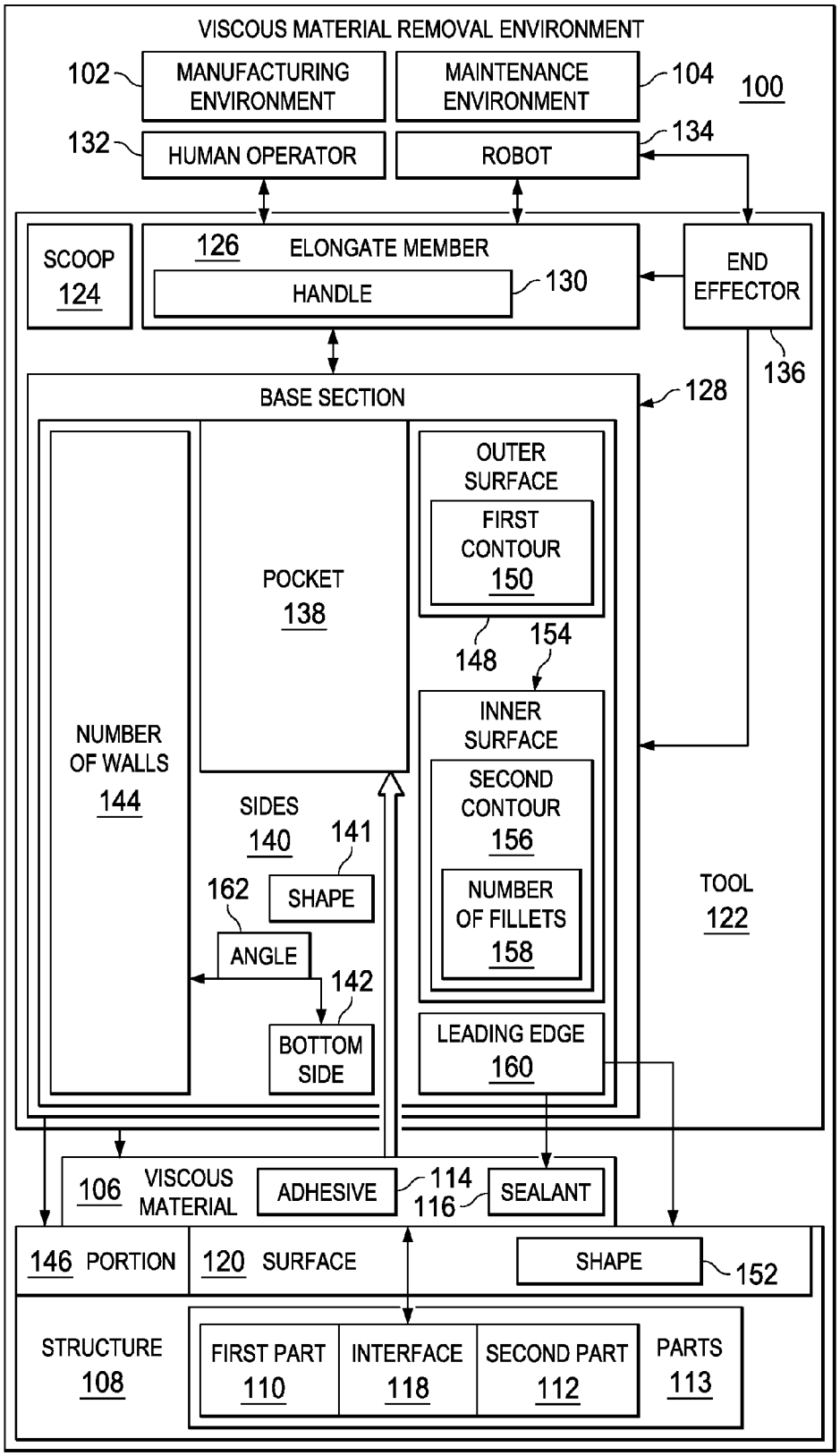
FIG. 1 is an illustration of a block diagram of a viscous material removal environment in accordance with an illustrative embodiment.

With reference to the figures, and in particular, with reference to FIG. 1, an illustration of a block diagram of a viscous material removal environment is depicted in accordance with an illustrative embodiment. As depicted, viscous material removal environment 100 may take various forms. For example, viscous material removal environment 100 may be manufacturing environment 102, maintenance environment 104, or some other suitable environment.

As depicted, viscous material 106 may be placed such that viscous material 106 applied to structure 108 is located between first part 110 and second part 112 in parts 113 that form structure 108. In these illustrative examples, parts 113 may be selected from at least one of a panel, a bracket, a fitting, a doubler, a stringer, a fuselage, a fuel tank, an airframe, a composite structure, or a skin panel.

As used herein, the phrase "at least one of," when used with a list of items, means different combinations of one or more of the listed items may be used and only one of each item in the list may be needed. In other words, at least one of means any combination of items and number of items may be used from the list but not all of the items in the list are required. The item may be a particular object, thing, or a category.

For example, without limitation, "at least one of item A, item B, or item C" may include, item A, item A and item B, or item B. This example also may include item A, item B, and item C or item B and item C. Of course, any combinations of these items may be present. In other examples, "at least one of" may be, for example, without limitation, two of item A; one of item B; and ten of item C; four of item B and seven of item C; or other suitable combinations.

In the illustrative example, viscous material 106 may be a material having a consistency between a solid and a liquid. In the illustrative example, viscous material 106 may flow prior to being cured. As depicted, viscous material 106 may be at least one of adhesive 114, sealant 116, or some other suitable material.

For example, when viscous material 106 takes the form of adhesive 114, viscous material 106 may bond first part 110 and second part 112 at interface 118 to each other to form structure 108. Interface 118 may be where first part 110 and second part 112 contact each other.

When first part 110 and second part 112 are placed against each other with viscous material 106, viscous material 106 may be located between first part 110 and second part 112 at interface 118. Additionally, viscous material 106 also may be located on surface 120 of structure 108 in locations other than at interface 118 between first part 110 and second part 112. For example, this viscous material 106 may be located on surface 120 of at least one of first part 110 or second part 112. In the illustrative example, viscous material 106 on surface 120 of structure 108 at locations other than interface 118 may be referred to as "squeeze out" or "excess viscous material."

As depicted, tool 122 may be used to remove viscous material 106 on surface 120 of structure 108. Tool 122 may take the form of scoop 124. When viscous material 106 takes the form of adhesive 114, scoop 124 may be an adhesive scoop.

In this illustrative example, scoop 124 may comprise elongate member 126 and base section 128. Elongate member 126 may take the form of handle 130 when scoop 124 is used by human operator 132. In other words, elongate member 126 may be handle 130 that is configured to be held by a hand of human operator 132. In some cases, elongate member 126 may be connected to robot 134 when elongate member 126 and base section 128 form end effector 136 for robot 134.

Base section 128 may be physically associated with elongate member 126. When one component is "physically associated" with another component, the association is a physical association in the depicted examples. For example, a first component, base section 128, may be considered to be physically associated with a second component, elongate member 126, by at least one of being secured to the second component, bonded to the second component, mounted to the second component, welded to the second component, fastened to the second component, or connected to the second component in some other suitable manner. The first component also may be connected to the second component using a third component. The first component may also be considered to be physically associated with the second component by being formed as part of the second component, extension of the second component, or both.

In this illustrative example, base section 128 may be configured to move along surface 120 of structure 108 and guide viscous material 106 on surface 120 of structure 108 into pocket 138 in base section 128. For example, base section 128 is configured to move along surface 120 of first part 110 and second part 112 of structure 108 in which base section 128 may have sides 140 that form pocket 138, in which sides 140 may have shape 141 that substantially conform to surface 120 of first part 110 and second part 112 of structure 108. Sides 140 may be configured to move along surface 120 of first part 110 and second part 112 of structure 108 and guide viscous material 106 on surface 120 of structure 108 into pocket 138 when sides 140 move along surface 120 of first part 110 and second part 112 of the structure 108. In the illustrative example, viscous material 106 may be present on surface 120 of at least one of first part 110 or second part 112.

In particular, sides 140 may include bottom side 142 and number of walls 144. In the illustrative example, number of walls 144 may extend from bottom side 142 to form pocket 138.

Further, sides 140 may be configured to move portion 146 of structure 108 and guide viscous material 106 on surface 120 of structure 108 into pocket 138 when sides 140 move along portion 146 of structure 108. In the illustrative example, viscous material 106 located in interface 118 between first part 110 and second part 112 is not considered to be located on surface 120 of structure 108.

In the illustrative example, sides 140 have an outer surface 148 with first contour 150 configured to substantially correspond to shape 152 of surface 120 of portion 146 of structure 108. First contour 150 may be substantially flat, curved, or some combination thereof. For example, if surface 120 is flat, first contour 150 also may be flat. If surface 120 has a curve, first contour 150 may have a curve that substantially corresponds to the curve of surface 120.

Additionally, sides 140 have inner surface 154 with second contour 156 configured to move viscous material 106 into pocket 138. In particular, second contour 156 may include number of fillets 158 configured to move viscous material 106 into pocket 138. In this illustrative example, a fillet in number of fillets 158 may be at least one of a curved surface or radius.

Further, base section 128 may have leading edge 160 in which leading edge 160 is configured to contact at least one of surface 120 of structure 108 and viscous material 106 on surface 120 of structure 108. More specifically, leading edge 160 may be located on bottom side 142 of base section 128. For example, leading edge 160 may contact surface 120 of first part 110.

In the illustrative example, number of walls 144 may extend at angle 162 relative to bottom side 142. Additionally, base section 128 may have angle 162 relative to elongate member 126. Angle 162 may be selected such that only leading edge 160 touches surface 120 without other parts of base section 128 touching surface 120 during use of scoop 124 to remove viscous material 106 from surface 120 of structure 108.

In the illustrative example, elongate member 126 and base section 128 may be comprised of a number of materials selected from at least one of polypropylene, polyethylene, a metal, polycarbonate, nylon, polytetrafluoroethylene, or other suitable materials. The number of materials may be the same or different materials between elongate member 126 and base section 128. As another illustrative example, the number of materials in base section 128 may be comprised of more than one type of material. As depicted, the number of materials may be selected such that at least one of elongate member 126 or base section 128 is rigid.

In the illustrative examples, scoop 124 may be manufactured in a number different ways. For example, scoop 124 may be manufactured using at least one of additive manufacturing processes, printing processes, injection molding processes, or other suitable processes.

In the illustrative example, scoop 124 may provide for the removal of viscous material 106 with a desired level of speed. Further, scoop 124 may provide human operator 132 with a desired ease-of-use when removing viscous material 106 from structure 108. Further, scoop 124 may be configured for quick and easy cleaning. In the illustrative example, scoop 124 may have a configuration that provides a finished or substantially finished seam at first part 110 and second part 112 on structure 108. The seam may be a bonded joint between first part 110 and second part 112.

Further, depending on the materials used, scoop 124 may be disposable. In other words, scoop 124 may be used for a particular period of time or any particular part.

The illustration of viscous material removal environment 100 in FIG. 1 is not meant to imply physical or architectural limitations to the manner in which an illustrative embodiment may be implemented. Other components in addition to or in place of the ones illustrated may be used. Some components may be unnecessary. Also, the blocks are presented to illustrate some functional components. One or more of these blocks may be combined, divided, or combined and divided into different blocks when implemented in an illustrative embodiment.

For example, in some illustrative examples, only a single wall may be present in number of walls 144. In other illustrative examples, elongate member 126 and base section 128 may be separate pieces connected to each other. In still other illustrative examples, viscous material 106 may comprise adhesive 114 and sealant 116.

Further, in some illustrative examples, a portion of viscous material 106 may be left on surface 120 of first part 110 and second part 112 of structure 108. For example, the portion of viscous material 106 may be left after the use of scoop 124 when viscous material 106 takes the form of sealant 116. In some cases, sealant 116 may only be applied to surface 120 and not between first part 110 and second part 112 at interface 118. The configuration of sides 140 may allow a desired portion of sealant 116 to remain on surface 120.

Figure 2:
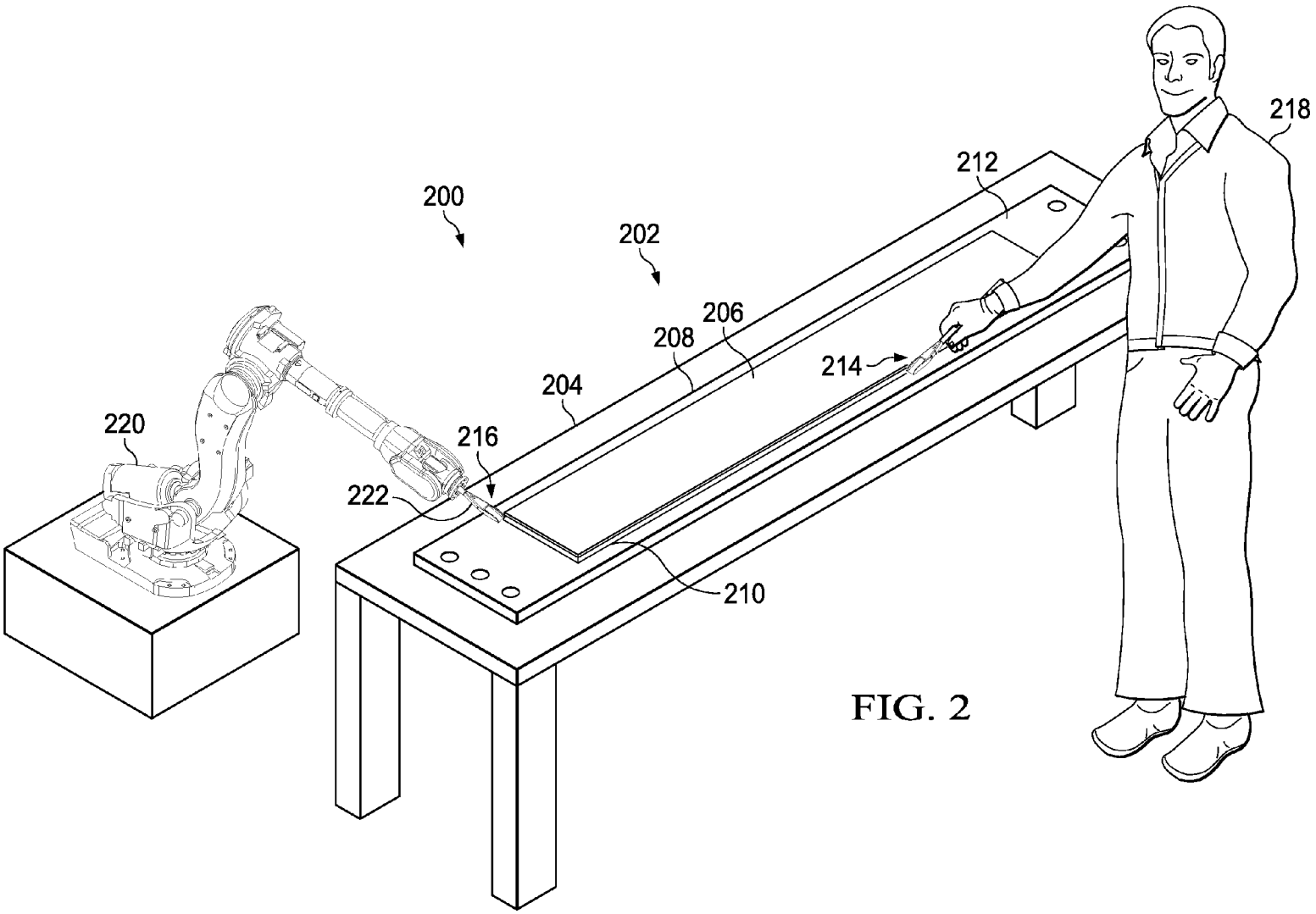
FIG. 2 is an illustration of a viscous material removal environment in accordance with an illustrative embodiment.

With reference next to FIG. 2, an illustration of a viscous material removal environment is depicted in accordance with an illustrative embodiment. As depicted, viscous material removal environment 200 is an example of a physical implementation of viscous material removal environment 100 shown in FIG. 1.

As depicted, structure 202 may be assembled on table 204. Structure 202 may be an example of a physical implementation of structure 108 in FIG. 1. In this particular example, structure 202 may include bracket 206 and panel 208. Bracket 206 and panel 208 may be examples of parts 113 in FIG. 1. For example, bracket 206 may be an example of a physical implementation for second part 112, and panel 208 may be an example of a physical implementation for first part 110 in FIG. 1. In this illustrative example, adhesive 210 may be used to bond bracket 206 and panel 208 to each other. In some illustrative examples, adhesive 210 may also function as a sealant.

Adhesive 210 may be located on surface 212 of structure 202. Surface 212 may be located on at least one of bracket 206 or panel 208. In this illustrative example, adhesive 210 on surface 212 may be excess adhesive and may be referred to as squeeze out.

As depicted, adhesive scoop 214 and adhesive scoop 216 may be used to remove adhesive 210 from surface 212 on structure 202. In this illustrative example, adhesive scoop 214 may be operated by human operator 218. Adhesive scoop 216 may be operated by robot 220. As depicted, robot 220 may be a robotic arm, crawler, or some other form of robot. In this type of implementation, adhesive scoop 216 may be end effector 222 for robot 220.

Figure 3:
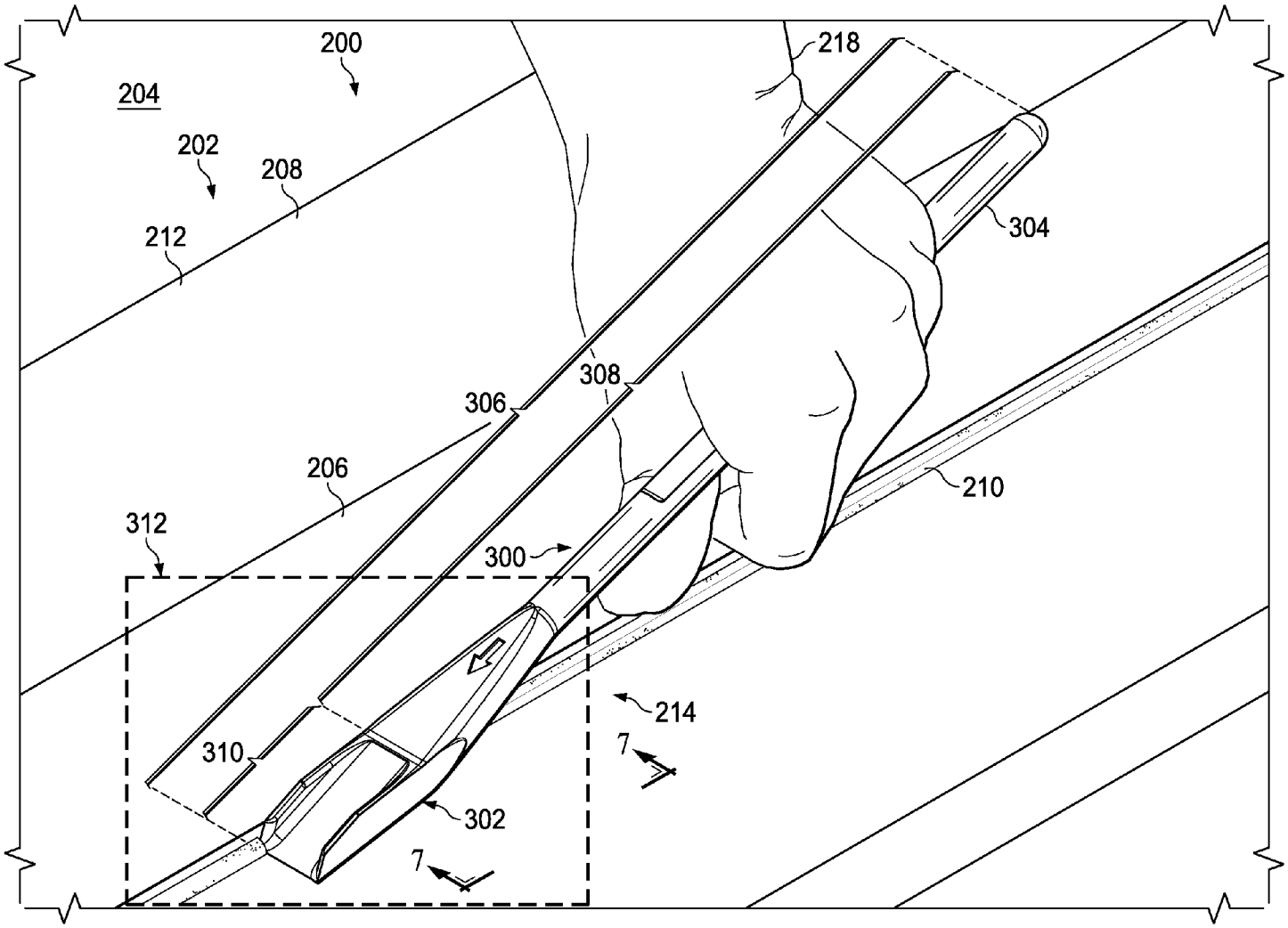
FIG. 3 is an illustration of an adhesive scoop in accordance with an illustrative embodiment.

With reference next to FIG. 3, an illustration of an adhesive scoop is depicted in accordance with an illustrative embodiment. In this illustrative example, adhesive scoop 214 is an example of one implementation for scoop 124 in FIG. 1.

As depicted, adhesive scoop 214 may have elongate member 300 and base section 302. In this illustrative example, elongate member 300 may have handle 304 for use by human operator 218 in FIG. 3.

In this illustrative example, adhesive scoop 214 may have length 306. Elongate member 300 may have length 308 and base section 302 may have length 310. In this particular example, length 306 may be about 6.6 inches; length 308 may be about 5.6 inches; and length 310 may be about 1.0 inches. An enlarged view of base section 302 in section 312 is shown in FIG. 4 and described below with respect to FIG. 4.

Figure 4:
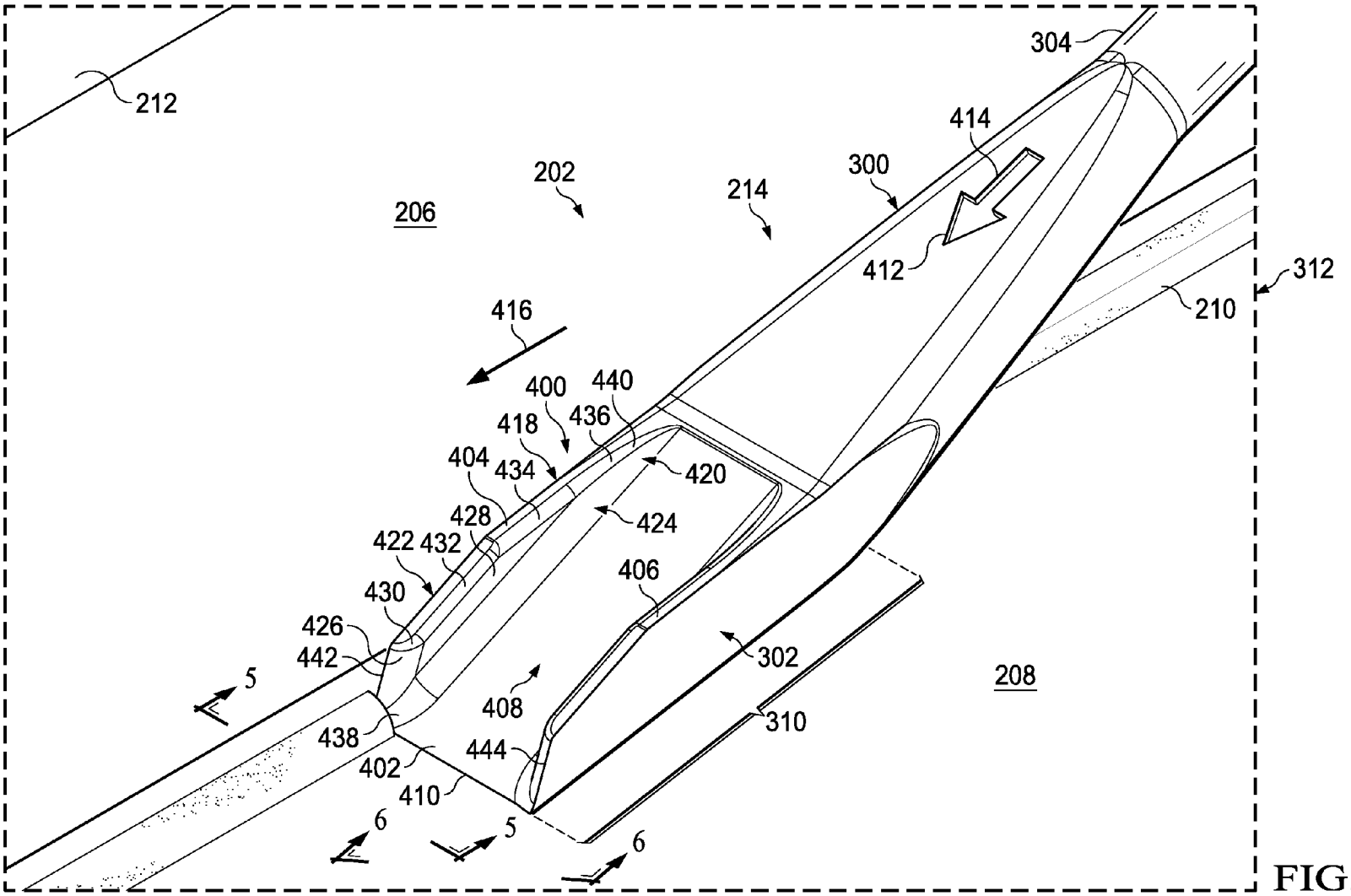
FIG. 4 is an illustration of an enlarged view of a base section for an adhesive scoop in accordance with an illustrative embodiment.

In FIG. 4, an illustration of an enlarged view of a base section for an adhesive scoop is depicted in accordance with an illustrative embodiment. In this view of section 312 from FIG. 3, sides 400 in base section 302 are shown. Sides 400 may include bottom side 402, wall 404, and wall 406. As depicted, sides 400 may form pocket 408.

In this illustrative example, base section 302 has leading edge 410. In particular, leading edge 410 may be located on bottom side 402 in sides 400 on base section 302.

As depicted, elongate member 300 of adhesive scoop 214 also may have indicator 412 in the form of arrow 414. Arrow 414 may indicate that adhesive scoop 214 should be moved in the direction of arrow 416 by human operator 218 in FIG. 2.

In this view, sides 400 have outer surface 418 and inner surface 420. Outer surface 418 may have first contour 422, while inner surface 420 may have second contour 424. Of course, in other illustrative examples, indicator 412 may be located on base section 302.

First contour 422 of outer surface 418 of sides 400 may be configured to substantially correspond to a portion of structure 202 such as bracket 206. As can be seen in this example, surface 212 of structure 202 at bracket 206 is substantially planar.

In a similar fashion, first contour 422 of outer surface 418 at wall 404 may substantially correspond by being substantially planar. In this illustrative example, panel 208 may also be substantially planar. First contour 422 of outer surface 418 at bottom side 402 may substantially correspond to surface 212 at panel 208 by being substantially planar.

If surface 212 of structure 202 at bracket 206 has a curve, first contour 422 of outer surface 418 at wall 404 may also have a curve to substantially correspond to the curve of surface 212 at bracket 206, such that wall 404 may abut or touch surface 212 at bracket 206 without a gap or without an undesired gap.

In other words, number of walls 144 in FIG. 1 may have first contour 422 at outer surface 418 that allows for easy and quick removal of adhesive 210 from surface 212 through the selection or design of first contour 422. In other words, first contour 422 may be selected such that adhesive 210 may be removed with a desired amount of ease and speed as adhesive scoop 214 is moved along structure 202. In the illustrative examples, first contour 422 may be designed to remove adhesive 210 in a single pass operation.

As another illustrative example, front edge 442 of wall 404 and front edge 444 of wall 406 may taper. This taper in front edge 442 and front edge 444 may help guide adhesive to return into pocket 408 in this illustrative example.

Additionally, the configuration of leading edge 410 also may be selected to remove adhesive 210 with a desired amount of ease and speed as adhesive scoop 214 is moved along surface 212 of structure 202 by human operator 218.

As depicted, second contour 424 of inner surface 420 for sides 400 may be configured to aid in guiding a viscous material (not shown) on surface 212 of structure 202 into pocket 408 of base section 302 when sides 400 of base section 302 move along a portion of structure 202. In this example, the portion may be at least one of bracket 206 or panel 208.

Also, second contour 424 may be comprised of fillets. For example, fillet 426, fillet 428, fillet 430, fillet 432, fillet 434, fillet 436, fillet 438, and fillet 440 may be in second contour 424 for wall 404 in sides 400. Each of these fillets may be configured to aid in moving adhesive 210 into pocket 408. Additionally, these fillets also may be configured for cleaning of adhesive scoop 214. For example, these and other fillets in second contour 424 may be designed to reduce snagging of a towel or other device used to clean adhesive scoop 214, remove adhesive 210 from adhesive scoop 214, or both clean adhesive scoop 214 and remove adhesive 210 from adhesive scoop 214.

Figure 5:
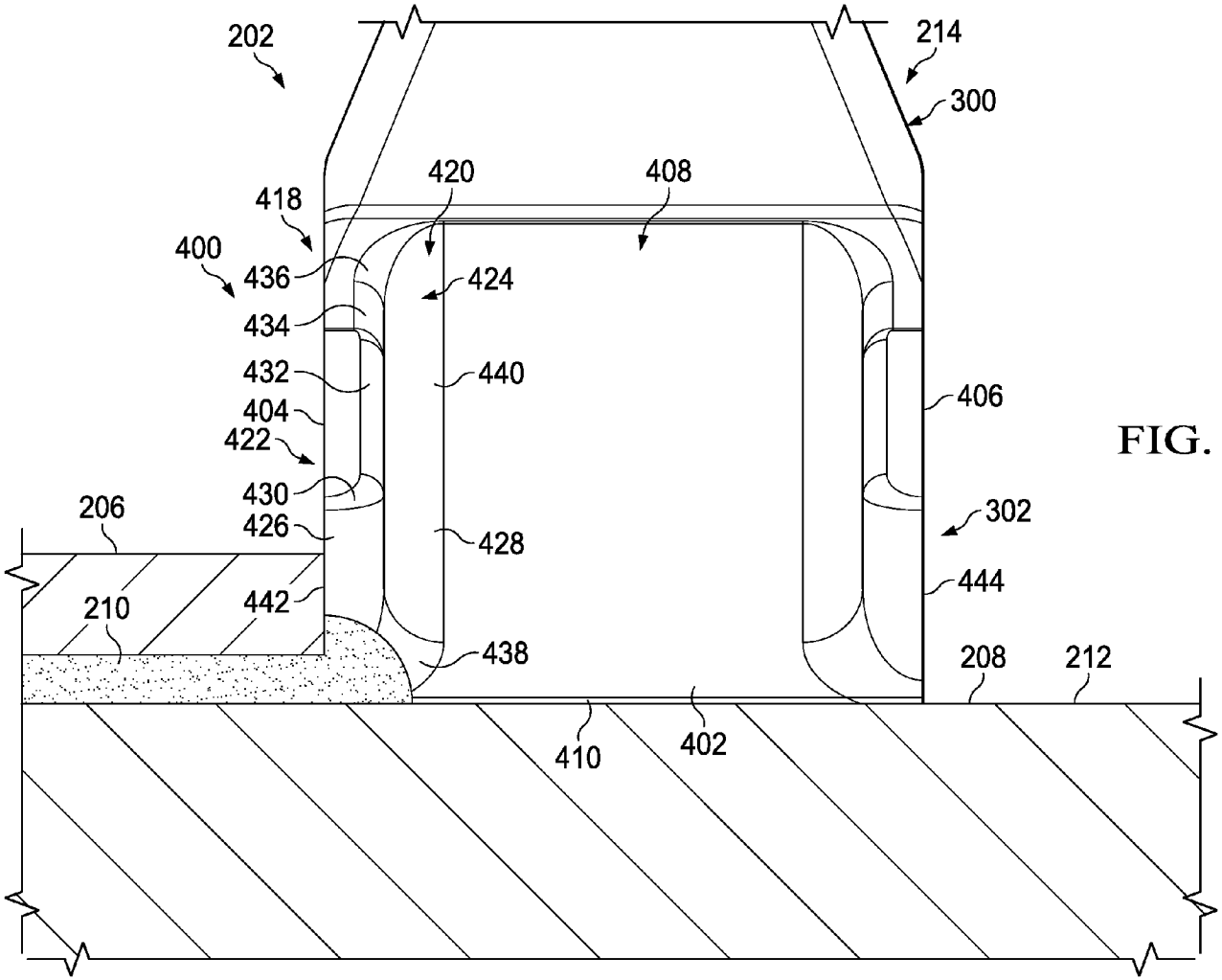
FIG. 5 is an illustration of an adhesive scoop in accordance with an illustrative embodiment.

Turning next to FIG. 5, an illustration of an adhesive scoop is depicted in accordance with an illustrative embodiment. In this figure, a front view of adhesive scoop 214 is seen in the direction of lines 5-5 in FIG. 4 is shown.

Figure 6:
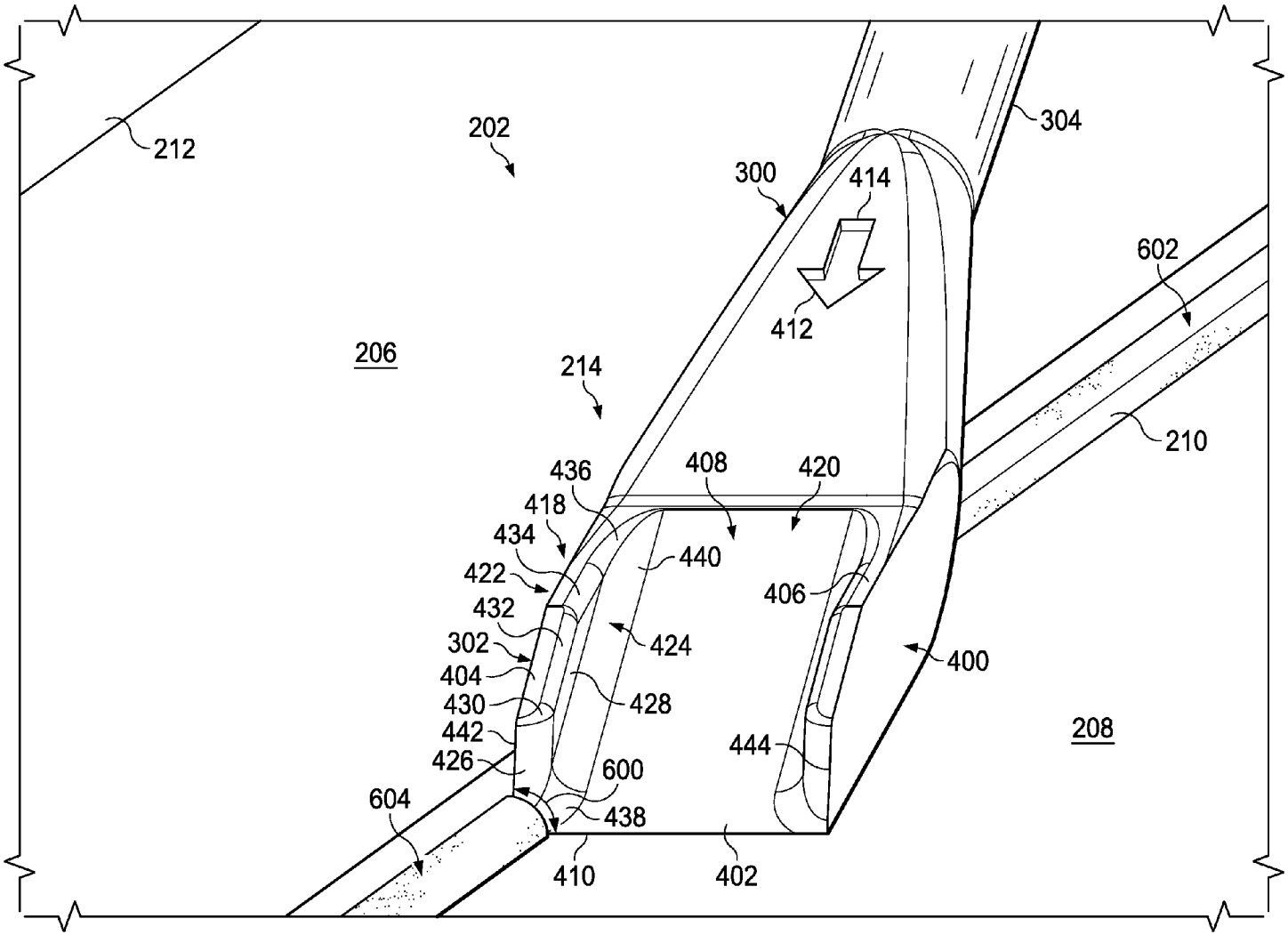
FIG. 6 is another illustration of an adhesive scoop in accordance with an illustrative embodiment.

With reference next to FIG. 6, another illustration of an adhesive scoop is depicted in accordance with an illustrative embodiment. As depicted in this figure, another front view of adhesive scoop 214 is seen in the direction of lines 6-6 in FIG. 4.

In this view, wall 404 may extend at angle 600 relative to bottom side 402. Wall 404 in this example may be substantially perpendicular to bottom side 402. Angle 600 may be about 90 degrees in this illustrative example. Of course, other angles may be selected depending on the particular implementation. The selection of the angles may be made such that outer surface 418 at wall 404 in sides 400 may touch bracket 206 (not shown) and outer surface 418 of leading edge 410 on bottom side 402 may touch panel 208 (not shown).

In FIG. 6, section 602 of adhesive 210 may be a film of adhesive 210 as compared to section 604 of adhesive 210. Section 602 may have at least one of an amount, shape, or other characteristic that is desired for section 604. In the illustrative examples, adhesive 210 in section 604 also may be removed using another device such as a cloth with a solvent (not shown). The removal may be performed easily with the use of adhesive scoop 214. A remaining portion of adhesive 210 in section 604 may have at least one of a desired amount or a desired shape. In some illustrative examples, it may be desirable to have at least one of a particular shape or amount of adhesive 210 remaining on surface 212 of structure 202. The amount, shape or both may be based on factors including at least one of aesthetics, sealing capability, specifications for the structure, or other suitable factors.

Figure 7:
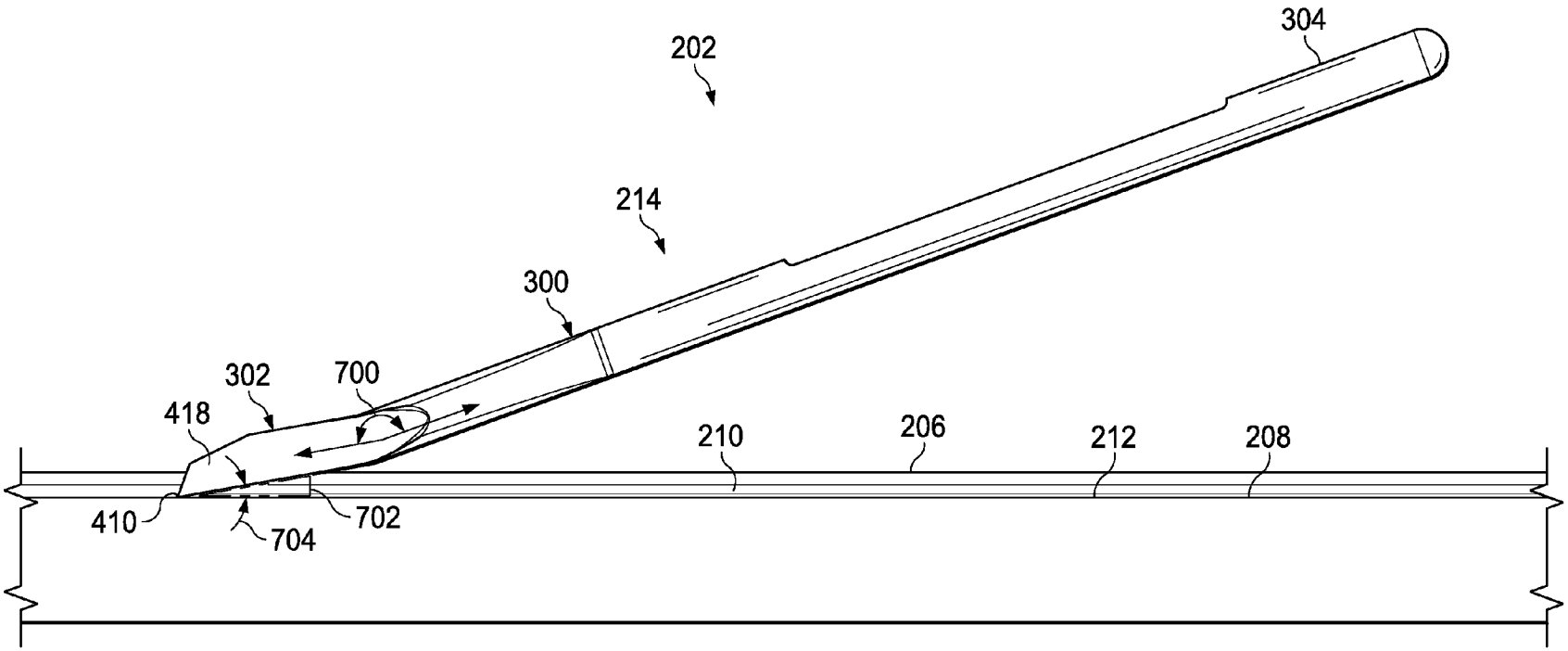
FIG. 7 is an illustration of a side view of an adhesive scoop in accordance with an illustrative embodiment.

With reference next to FIG. 7, an illustration of a side view of an adhesive scoop is depicted in accordance with an illustrative embodiment. Adhesive scoop 214 is shown in a side view in the direction of lines 7-7 in FIG. 3.

In this view, base section 302 may have angle 700 relative to elongate member 300. Angle 700 may be selected such that leading edge 410 may contact surface 212 at panel 208 without other portions of outer surface 418 on bottom side 402 contacting panel 208.

The illustration of adhesive scoop 214 in FIGS. 2-7 is an example of a physical implementation for scoop 124 shown in block form in FIG. 1. Illustration of adhesive scoop 214 in FIGS. 2-7 is not meant to limit the manner in which other illustrative examples may be implemented. For example, indicator 412 may be omitted in other implementations. As another illustrative example, first contour 422 of outer surface 418 of sides 400 may be curved instead of substantially planar as shown in these examples.

In yet another illustrative example, guide structure 702 may be physically associated with bottom side 402 of base section 302 such that leading edge 410 contacts panel 208 in a desired manner to remove adhesive 210 on surface 212. Guide structure 702 may be shaped such that base section 302 has desired angle 704 when leading edge 410 contacts surface 212 of panel 208 and maintains angle 704 as adhesive 210 moves along surface 212. Angle 704 may be a predetermined angle of attack that causes removal of adhesive 210 from surface 212 in a desired manner.

In another illustrative example, length 310 of base section 302 may be increased in length. The length may be increased such that more adhesive, sealant, or both may be scooped up using adhesive scoop 214.

Figure 8:
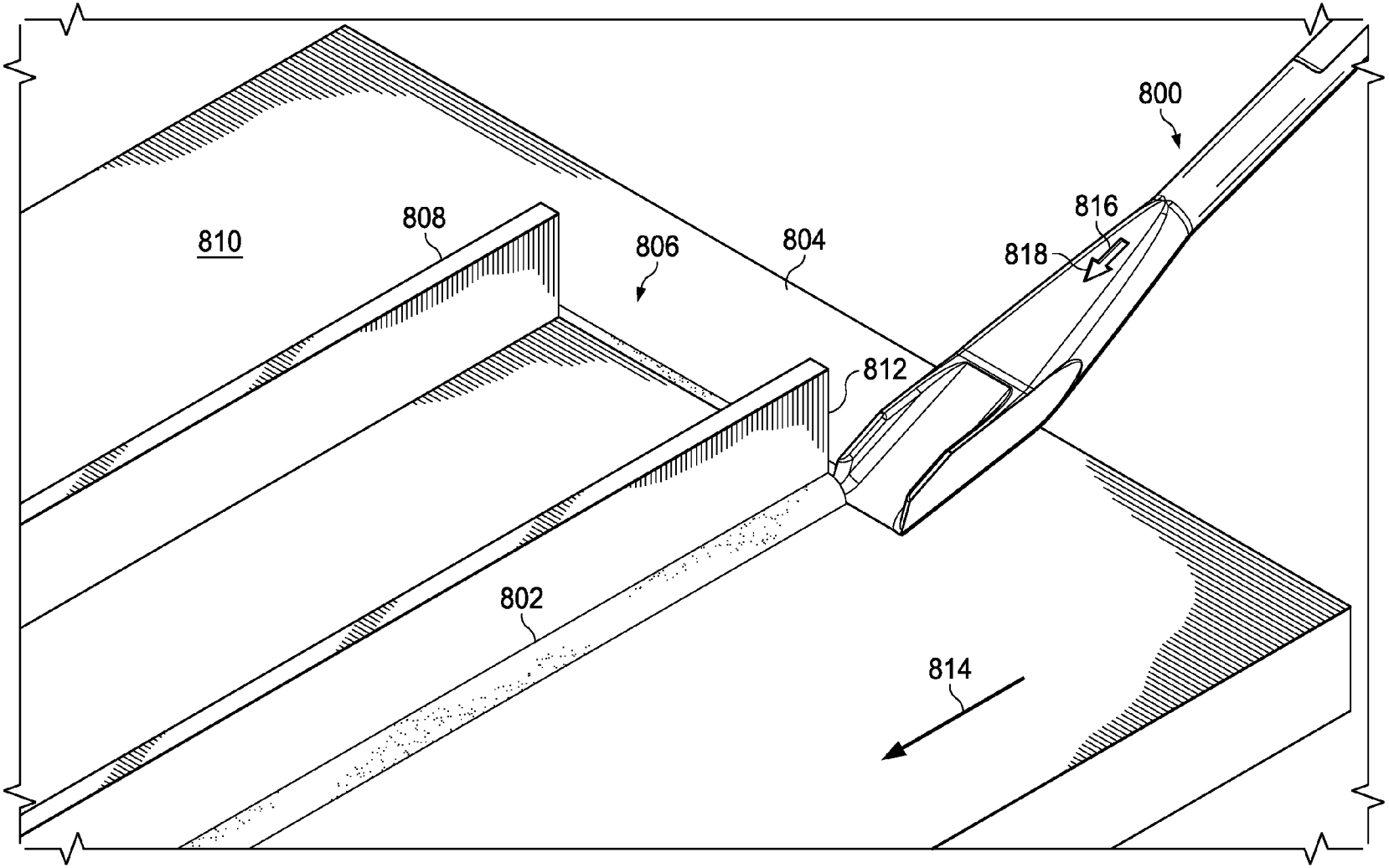
FIG. 8 is an illustration of an adhesive scoop used to remove adhesive from a structure in accordance with an illustrative embodiment.
Figure 9:
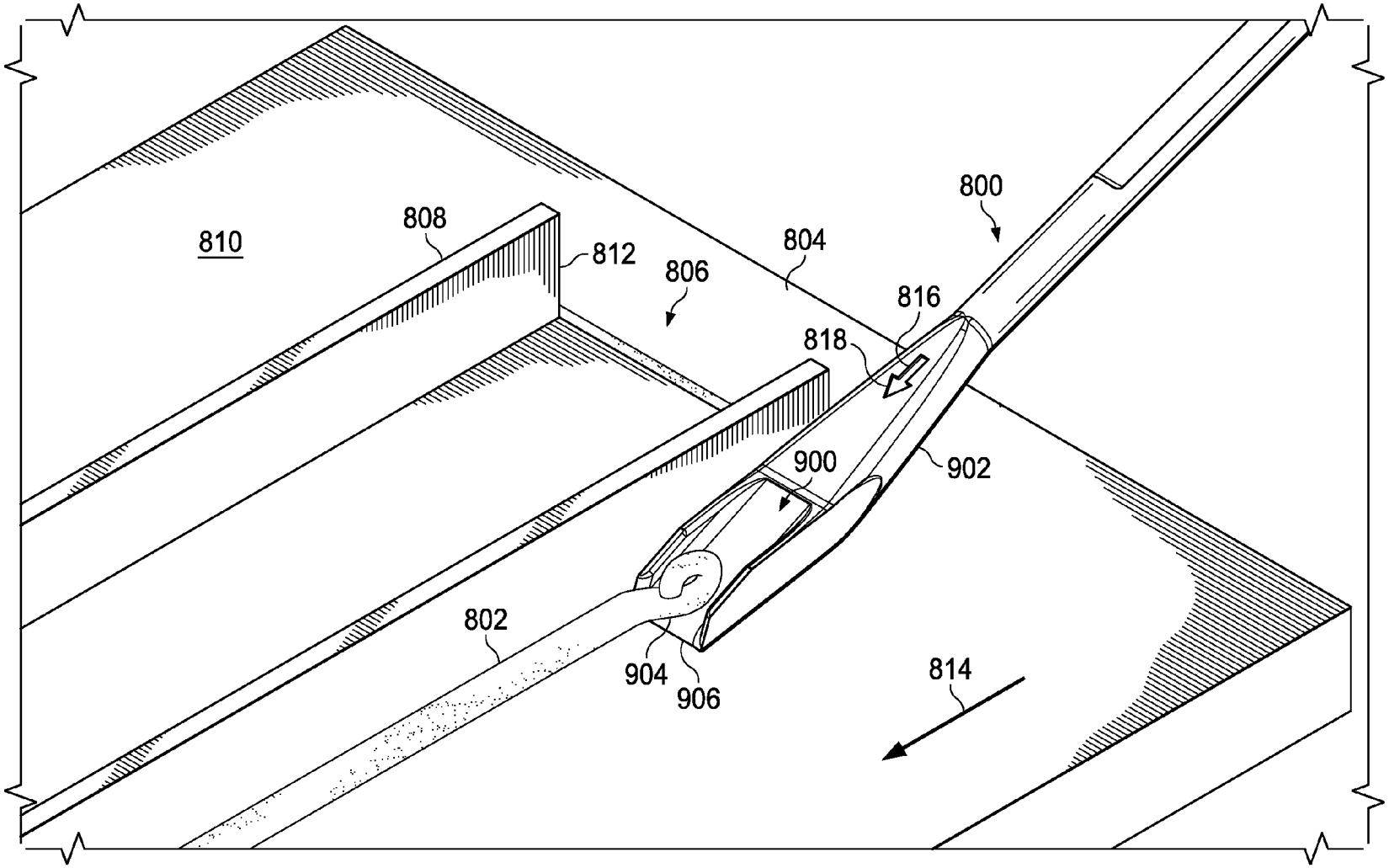
FIG. 9 is an illustration of the removal of adhesive from the surface of a structure using an adhesive scoop in accordance with an illustrative embodiment.
Figure 10:
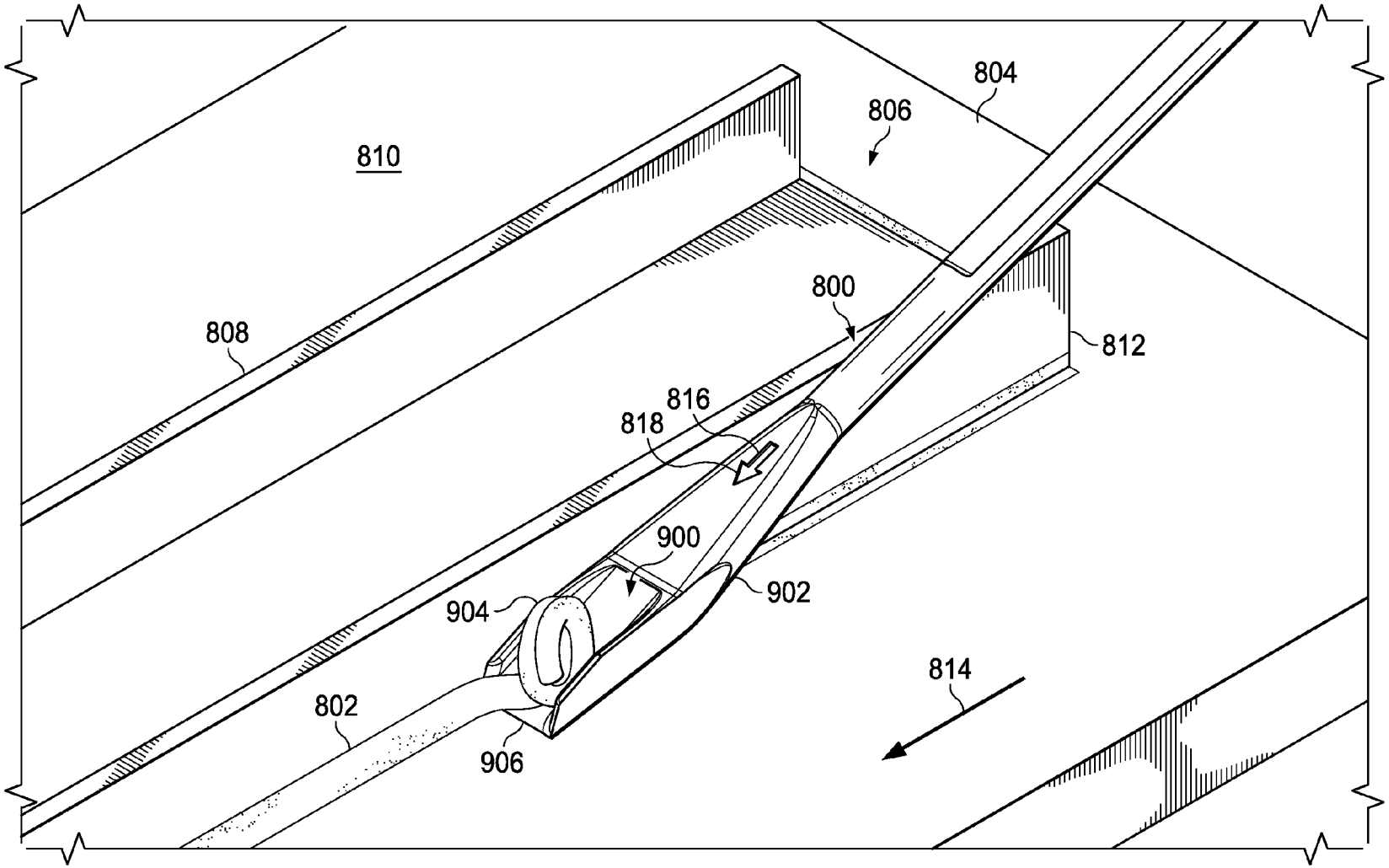
FIG. 10 is another illustration of the removal of adhesive from the surface of a structure using an adhesive scoop in accordance with an illustrative embodiment.

Turning now to FIGS. 8-10, an illustration of a process for removing a viscous material such as an adhesive from a structure is depicted in accordance with an illustrative embodiment. These figures illustrate removal of adhesive from a structure.

With reference to FIG. 8, an illustration of an adhesive scoop used to remove adhesive from a structure is depicted in accordance with an illustrative embodiment. In this depicted example, adhesive scoop 800 may be used to remove adhesive 802 from surface 804 of structure 806.

In this illustrative example, structure 806 may be formed from bonding bracket 808 to panel 810 with adhesive 802. As can be seen, adhesive 802 can be seen on surface 804 of bracket 808 and panel 810 at edge 812 of bracket 808.

In this example, adhesive scoop 800 may be moved in the direction of arrow 814 to remove adhesive 802 from surface 804 of structure 806. This removal also may be referred to as "scooping" in this illustrative example.

As depicted, indicator 816 in the form of arrow 818 may be present on adhesive scoop 800. Arrow 818 may indicate a direction of movement for using adhesive scoop 800.

In FIG. 9, an illustration of the removal of adhesive from the surface of a structure using an adhesive scoop is depicted in accordance with an illustrative embodiment. In this figure, adhesive scoop 800 has been moved along edge 812 of bracket 808. This movement may result in the removal of adhesive 802 located on surface 804 of structure 806 at edge 812 of bracket 808.

As can be seen in this illustrative example, adhesive 802 may be removed from surface 804 and guided into pocket 900 in base section 902 of adhesive scoop 800 as adhesive scoop 800 is moved in the direction of arrow 814. Adhesive scoop 800 is an example of one physical implementation for scoop 124 shown in block form in FIG. 1.

As depicted in this illustrative example, wall 904 in base section 902 is configured to remove adhesive 802 from edge 812 at bracket 808 and guide adhesive 802 into pocket 900. Additionally, leading edge 906 in base section 902 is configured to remove adhesive 802 from surface 804 of panel 810 and guide adhesive 802 into pocket 900. In this illustrative example, the guiding of adhesive 802 may result in adhesive 802 "rolling" into pocket 900.

In FIG. 10, another illustration of the removal of adhesive from the surface of a structure using an adhesive scoop is depicted in accordance with an illustrative embodiment. In this figure, adhesive scoop 800 has been moved further along structure 806 in the direction of arrow 814.

Any remaining amounts of adhesive 802 on surface 804 of structure 806 may be removed using another tool. The tool may be, for example, without limitation, a towel (not shown) with a solvent to remove any amounts of adhesive 802 that may still be on surface 804 of structure 806. With the use of adhesive scoop 800, the amount of time needed to remove adhesive 802 may be reduced as compared to currently used techniques. In addition, the ease of removing adhesive 802 also may be increased as compared to currently used techniques.

After adhesive 802 has been guided into pocket 900, adhesive scoop 800 may be cleaned. In these illustrative examples, adhesive scoop 800 may be configured for cleaning that may be as quick and easy as desired. This cleaning may be achieved through the configuration of surface 804 of adhesive scoop 800. Surface 804 may be curved such that a rag or other cleaning device does not catch on adhesive scoop 800 while cleaning adhesive scoop 800.

The illustrations of the different operations performed in FIGS. 8-10 are not meant to limit the manner in which operations may be performed to remove adhesive 802 from surface 804. For example, more than one adhesive scoop may be used at the same time to remove adhesive 802 from surface 804 of structure 806. In other illustrative examples, adhesive scoop 800 may also be used to remove sealant (not shown) from structure 806 in addition to or in place of adhesive 802.

The different components shown in FIGS. 2-10 may be combined with components in FIG. 1, used with components in FIG. 1, or a combination of the two. Additionally, some of the components in FIGS. 2-10 may be illustrative examples of how components shown in block form in FIG. 1 can be implemented as physical structures.

Figure 11:
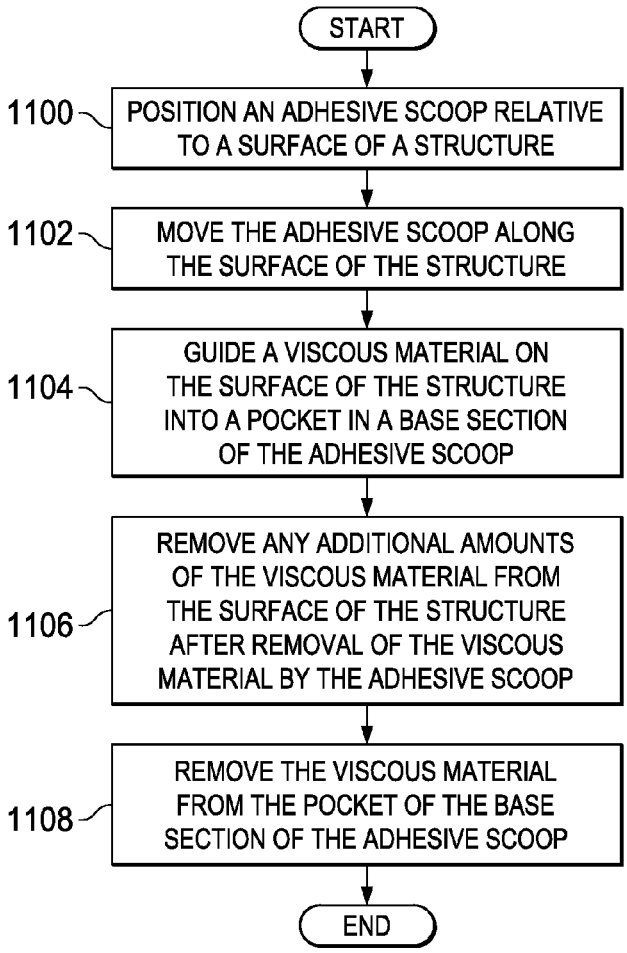
FIG. 11 is an illustration of a flowchart of a process for removing a viscous material from a structure in accordance with an illustrative embodiment.

With reference now to FIG. 11, an illustration of a flowchart of a process for removing a viscous material from a structure is depicted in accordance with an illustrative embodiment. The process illustrated FIG. 11 may be implemented in viscous material removal environment 100 using scoop 124 in FIG. 1 to remove viscous material 106 of structure 108.

The process may begin by positioning scoop 124 relative to surface 120 of structure 108 (operation 1100). In operation 1100, leading edge 160 of the scoop may be placed on a first part of a structure. In operation 1100, the positioning may also include setting the angle of scoop 124 and in particular setting leading edge 160 relative to surface 120 of first part 110 to desired angle 704 while leading edge 160 contacts surface 120 of first part 110 using guide structure 702 that may be physically associated with bottom side 142 of base section 128 of scoop 124.

The process may then move scoop 124 along surface 120 of structure 108 (operation 1102). In this example, scoop 124 may include elongate member 126 and base section 128 that may be physically associated with an end of elongate member 126 in which base section 128 may be configured to move along surface 120 of structure 108. Viscous material 106 on surface 120 of structure 108 may be guided into pocket 138 in base section 128 of scoop 124 (operation 1104).

Any additional amounts of viscous material 106 may be removed from surface 120 of structure 108 after removal of viscous material 106 by adhesive scoop 214 (operation 1106). Operation 1106 may be performed using a tool such as a towel with a solvent. Viscous material 106 may be removed from pocket 138 of base section 128 of adhesive scoop 214 (operation 1108), with the process terminating thereafter. Removal of viscous material 106 from pocket 138 may be performed in a similar fashion to the removal of viscous material 106 in operation 1106.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent at least one of a module, a segment, a function, or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

For example, operation 1108 may be performed prior to operation 1106. In some illustrative examples, operation 1108 and operation 1106 may be performed at the same time by different operators. In these illustrative examples, the different operations illustrated in the flowchart of FIG. 11 may be performed by at least one of a human operator or a robot.

Figure 12:
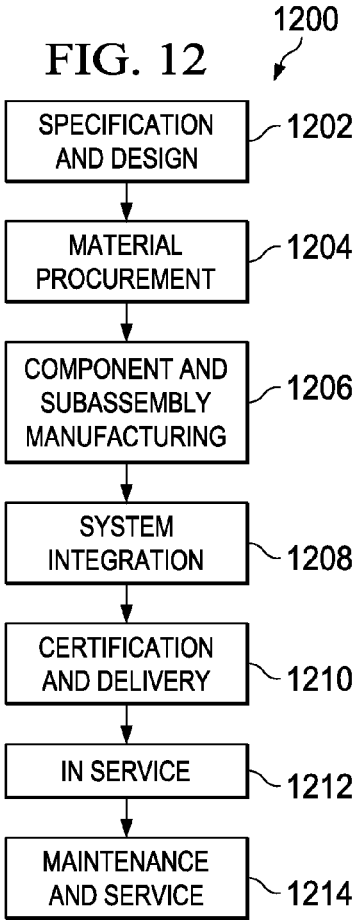
FIG. 12 is an illustration of a block diagram of an aircraft manufacturing and service method in accordance with an illustrative embodiment.
Figure 13:
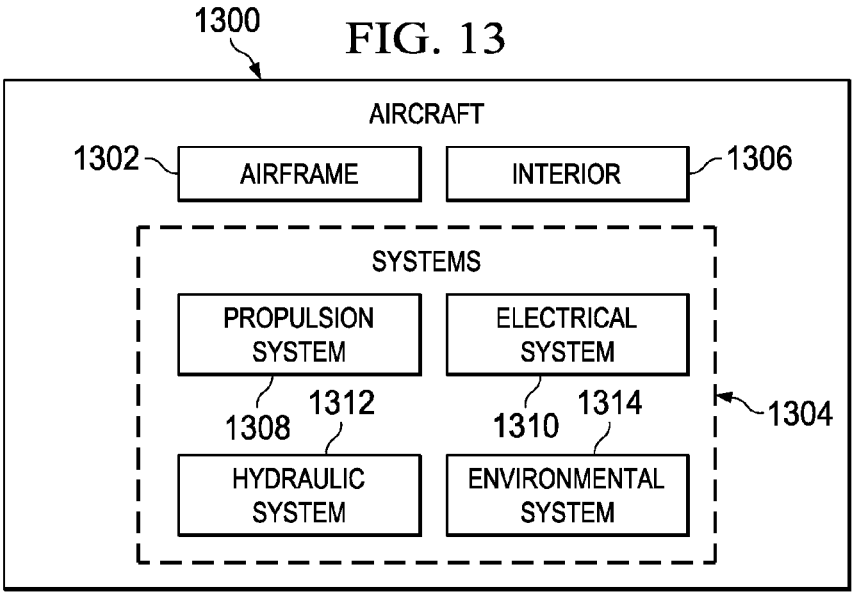
FIG. 13 is an illustration of a block diagram of an aircraft in which an illustrative embodiment may be implemented.

Illustrative embodiments of the disclosure may be described in the context of aircraft manufacturing and service method 1200 as shown in FIG. 12 and aircraft 1300 as shown in FIG. 13. Turning first to FIG. 12, an illustration of a block diagram of an aircraft manufacturing and service method is depicted in accordance with an illustrative embodiment. During pre-production, aircraft manufacturing and service method 1200 may include specification and design 1202 of aircraft 1300 in FIG. 13 and material procurement 1204.

During production, component and subassembly manufacturing 1206 and system integration 1208 of aircraft 1300 in FIG. 13 takes place. Thereafter, aircraft 1300 in FIG. 13 may go through certification and delivery 1210 in order to be placed in service 1212. While in service 1212 by a customer, aircraft 1300 in FIG. 13 is scheduled for routine maintenance and service 1214, which may include modification, reconfiguration, refurbishment, and other maintenance or service.

Each of the processes of aircraft manufacturing and service method 1200 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 13, an illustration of a block diagram of an aircraft is depicted in which an illustrative embodiment may be implemented. In this example, aircraft 1300 is produced by aircraft manufacturing and service method 1200 in FIG. 12 and may include airframe 1302 with plurality of systems 1304 and interior 1306. Examples of systems 1304 include one or more of propulsion system 1308, electrical system 1310, hydraulic system 1312, and environmental system 1314. Any number of other systems may be included. Although an aerospace example is shown, different illustrative embodiments may be applied to other industries, such as the automotive industry. Apparatuses and methods embodied herein may be employed during at least one of the stages of aircraft manufacturing and service method 1200 in FIG. 12.

In one illustrative example, components or subassemblies produced in component and subassembly manufacturing 1206 in FIG. 12 may be fabricated or manufactured in a manner similar to components or subassemblies produced while aircraft 1300 is in service 1212 in FIG. 12. As yet another example, one or more apparatus embodiments, method embodiments, or a combination thereof may be utilized during production stages, such as component and subassembly manufacturing 1206 and system integration 1208 in FIG. 12. For example, without limitation, an illustrative embodiment may be used during component and subassembly manufacturing 1206, system integration 1208, or both, to remove a viscous material such as an adhesive, sealant in the form of squeeze out, resulting from bonding parts to each other. An illustrative embodiment may also be used during certification and delivery 1210 to remove an adhesive, sealant, or both from surfaces of aircraft 1300.

As another illustrative example, one or more apparatus embodiments, method embodiments, or a combination thereof may be utilized while aircraft 1300 is in service 1212 during maintenance and service 1214 in FIG. 12, or both to remove excess adhesive that may result from bonding parts to each other to form structures. The use of a number of the different illustrative embodiments may substantially expedite the assembly of aircraft 1300, reduce the cost of aircraft 1300, or both expedite the assembly of aircraft 1300 and reduce the cost of aircraft 1300. In one or more illustrative examples, an illustrative embodiment may be used to remove an adhesive, a sealant, or both from airframe 1302, systems 1304, interior 1306, or other locations in aircraft 1300.

Thus, the different illustrative embodiments provide a method and apparatus for removing adhesive. For example, an illustrative embodiment apparatus, method, or both, may be used to remove excess adhesive from parts bonded to each other using adhesive.

For example, without limitation, the illustrative embodiments may be used to remove adhesive in a manner that reduces at least one of time, effort, or cost of manufacturing a platform, such as an aircraft.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus that comprises:

a base section that comprises a rigid unitary form that comprises: a bottom side, a first wall, and a second wall, such that each wall respectively comprises: a front edge, an outer surface, and an inner surface, such that:

the front edge of each wall connects to the inner surface via a respective first fillet that comprises a curved shape that tapers away from the outer surface of the each wall respectively;

each wall extends, in a similar direction, from the bottom side and forms a pocket that comprises a depth that decreases from a height, of a front edge of the first wall at a leading edge of the bottom side, of the base section, down to no depth at an end, opposite the leading edge of the bottom side, that joins into an elongate member of the rigid unitary form;

the inner surface of each wall respectively comprises a number of fillets that each comprise curves; and the base section configured such that the pocket and each fillet comprise contours shaped to preclude a portion of a cleaning fabric from being caught on the base section.

2. The apparatus of claim 1, wherein the outer surface comprises a shape curved to contact and move along a surface of a structure such that the leading edge guides a viscous material on the surface of the structure into the pocket.

3. The apparatus of claim 1, wherein an elongate member comprises an end that is physically associated with the base section.

4. The apparatus of claim 1, wherein the outer surface comprises a first contour that comprises a shape that corresponds to a great degree to a shape, of a structure abutted by the base section.

5. The apparatus of claim 2, wherein, respectively, the inner surface of each wall comprises a second contour configured to guide the viscous material into the pocket.

6. The apparatus of claim 5, wherein the second contour comprises fillets in the number of fillets configured to move the viscous material into the pocket.

7. The apparatus of claim 2, wherein the bottom side comprises the leading edge set at a specified angle relative to an elongate member physically associated with the base section.

8. The apparatus of claim 7, further comprising the leading edge configured to contact the surface of the structure and the viscous material on the surface of the structure.

9. The apparatus of claim 8 further comprising a guide structure that extends, opposite a direction that the walls extend from the bottom side, such that the leading edge maintains a desired angle when the leading edge contacts the surface of the structure.

10. The apparatus of claim 1, wherein the walls extend at an angle relative to the bottom side, and respectively, each wall joins, on the inner surface, the bottom side via additional fillets in the number of fillets.

11. The apparatus of claim 3, wherein a line defined by a length of the bottom side forms an angle relative to a line defined by a length of the elongate member.

12. The apparatus of claim 3, wherein the elongate member and the base section are comprised of a number of materials selected from at least one of: polypropylene, polyethylene, a metal, polycarbonate, polytetrafluoroethylene, and nylon.

13. The apparatus of claim 3, further comprising the elongate member configured as a handle configured to be held manually.

14. The apparatus of claim 3, wherein the elongate member and the base section form an end effector.

15. The apparatus of claim 1, wherein an outer surface of at least one of: the bottom side, the first wall, and the second wall each respectively comprise a curve that comprises a shape that corresponds to a great degree to a shape of at least one of: a panel, a bracket, a stringer, a fuselage, a fuel tank, an airframe, a composite structure, and a skin panel.

16. The apparatus of claim 2, wherein the viscous material is selected from at least one of an adhesive and a sealant.

17. A method for removing a viscous material from a structure, the method comprising:

providing a scoop comprising a base section comprising a rigid unitary form comprising a bottom side, a first wall, and a second wall, each wall extending, in a similar direction, from the bottom side and forming a pocket comprising a depth decreasing from a height, of a front edge of the first wall at a leading edge of the bottom side, of the base section, down to no depth toward an end, of the base section opposite a leading edge of the bottom side, that joins into an elongate member of the rigid unitary form, and each wall respectively comprising: a front edge, an outer surface, and an inner surface, each inner surface respectively comprising a first fillet comprising a curved shape that terminates at the front edge of the each wall respectively, the base section further comprising contours precluding the base section from catching any portion of a cleaning fabric wiped along the base section;

setting an angle, between the bottom side and a surface of the structure, comprising a vertex at the leading edge of the bottom side;

moving the scoop along a surface of the structure; and guiding, via fillets along an interior surface of the pocket and the angle, a portion of the viscous material on the surface of the structure into the pocket as the scoop moves along the surface of the structure.

18. The method of claim 17, further comprising, the outer surface shaped such that after moving the scoop along the surface, a remaining portion of the viscous material remains on the surface of the structure and comprises at least one of: a desired amount, and a desired shape.

19. The method of claim 17 wherein:

the outer surface comprises a curved shape conforming to a curved shape of the structure that abuts the outer surface; and removing the viscous material from the pocket of the base section.

20. The method of claim 17, wherein the outer surface of at least one wall comprises a contour corresponding to a shape of the surface of the structure.

21. The method of claim 19, wherein the pocket comprises an inner surface comprising a contour shaped for moving the viscous material into the pocket while moving the scoop along the structure.

22. The method of claim 21, wherein the contour comprises curved fillets moving the viscous material into the pocket.

23. The method of claim 17, wherein:

the bottom side comprises the leading edge contacting the surface while moving the scoop; and the walls extend from the bottom side, each wall comprising at least six fillets.

24. The method of claim 22, wherein the base section comprises the leading edge contacting the surface of the structure and the viscous material on the surface of the structure.

25. The method of claim 24, wherein:

the base section comprises a guide structure extending, in a direction away from the walls, from the bottom side of the base section; and maintaining the leading edge at a desired angle when the guide structure and the leading edge contact the surface of the structure.

26. The method of claim 23, wherein the walls extend at an angle relative to the bottom side.

27. The method of claim 17, wherein the base section comprises an angle relative to a length of an elongate member physically associated with the base section.

28. An adhesive scoop that comprises:

an elongate member; and a base section associated with an end of the elongate member in which the base section comprises:

a line defined by a length of the base section that forms an angle relative to a line defined by a length of the elongate member;

a rigid unitary form that comprises sides that comprise: a first side configured as a first wall, a second side configured as a second wall, and a bottom side, that form a pocket that comprises a depth that decreases from a height, of a front edge of the first wall at a leading edge of the bottom side, of the base section, down to no depth toward an end, opposite a leading edge of the bottom side, that joins into an elongate member of the rigid unitary form, opposite the leading edge of the bottom side of the pocket, of the base section, such that at least two sides of the pocket comprise a shape that conforms to: a surface of a first part of a structure, and a surface of a second part of the structure, respectively, and the at least two sides of the pocket configured such that the at least two sides move along the surface of the first part of the structure and the second part of the structure and guide a viscous material on at least one of the surface of the first part of the structure and the surface of the second part of the structure into the pocket when the at least two sides of the pocket move along the surface of the first part of the structure and the surface of the second part of the structure respectively, such that at least one of a desired amount and a desired shape of the viscous material remains on at least one of: the surface of the first part of the structure and the surface of the second part of the structure;

the first wall and the second wall respectively each extend away from the bottom side and the first wall and the second wall each comprise a front edge connected to an inner surface respectively via a fillet respectively that tapers away from an outer surface of the respective wall, such that the first wall and the second wall each comprise an inner surface respectively that comprises a number of fillets that comprise curved shapes configured to move the viscous material into the pocket;

each leading edge configured to contact at least one of the surface of the first part of the structure and the surface of the second part of the structure, and contact the viscous material on the surface of the structure; and a guide structure physically associated with the bottom side such that the leading edge maintains a desired angle relative to the surface when the guide structure and the leading edge contact the surface.

29. The adhesive scoop of claim 28, further comprising the elongate member comprises a handle configured to be held manually; and a side of the base section comprises a curved shape that corresponds to a shape of the surface of the structure.

30. The adhesive scoop of claim 28, wherein the elongate member and the base section form an end effector for a robot.

31. A method for setting and maintaining a desired angle of a bottom side of a base section of a scoop relative to a surface of a structure the scoop moves along, the method comprising:

placing a leading edge of the scoop on the surface of the structure; and physically associating a guide structure with the bottom side and placing the guide structure on the surface of the structure, thus setting an angle, between the bottom side and the surface, comprising a vertex at the leading edge, to a desired, the scoop comprising:

a base section comprising a rigid unitary form comprising the bottom side, a first wall, and a second wall, each wall extending, in a similar direction, from the bottom side and forming a pocket comprising a depth decreasing from a height, of a front edge of the first wall at a leading edge of the bottom side, of the base section, down to no depth toward an end of the base section opposite a leading edge of the bottom side, that joins into an elongate member of the rigid unitary form, and each wall respectively comprising: a front edge, an outer surface, and an inner surface, each front edge connected to an inner surface respectively via a fillet comprising a curved shape respectively tapering away from the outer surface of the each wall, and each inner surface respectively comprising a number of curved fillets, the base section further comprising contours precluding the base section from catching any portion of a cleaning fabric wiped along the base section.

* * * * *